US005431068A

United States Patent [19]

Alsch

[11] Patent Number: 5,431,068

[45] Date of Patent: Jul. 11, 1995

[54] BLADE SHARPENER

[76] Inventor: Richard Alsch, Box 304, Lannon, Wis. 53046

[21] Appl. No.: 307,423

[22] Filed: Sep. 19, 1994

[51] Int. Cl.[6] ..... B21K 5/12

[52] U.S. Cl. ..... 76/82; 269/3; 451/371

[58] Field of Search ..... 76/82, 88, 7, 103; 269/1, 3; 51/371; 451/371

[56] References Cited

U.S. PATENT DOCUMENTS

| | | | |
|---|---|---|---|
| D. 273,081 | 3/1984 | LeVine | D8/93 |
| D. 278,237 | 4/1985 | LeVine | D8/71 |
| 1,152,321 | 8/1915 | Kimball | 76/82 |
| 3,733,933 | 5/1973 | Longbrake | 76/88 |
| 4,170,343 | 10/1979 | Longbrake | 269/3 |
| 4,404,873 | 9/1983 | Radish | 76/82 |
| 4,471,951 | 9/1984 | LeVine | 269/3 |
| 4,486,982 | 12/1984 | Longbrake | 51/68 |
| 4,512,112 | 4/1985 | LeVine | 51/221 BS |
| 4,777,770 | 10/1988 | LeVine | 51/205 R |

*Primary Examiner*—Douglas D. Watts
*Attorney, Agent, or Firm*—Joseph S. Heino

[57] ABSTRACT

A blade sharpener includes a support rod, a blade clamping portion which is movable along the support rod, and a guide block which is located along the support rod, the guide block further having a honing tool rod extending through it which allows the honing tool rod to rotate freely about the support rod and substantially away from the horizontal to provide almost limitless motion and incrementally precise angular positioning of the honing tool rod relative to a blade secured within the blade clamping portion.

12 Claims, 2 Drawing Sheets

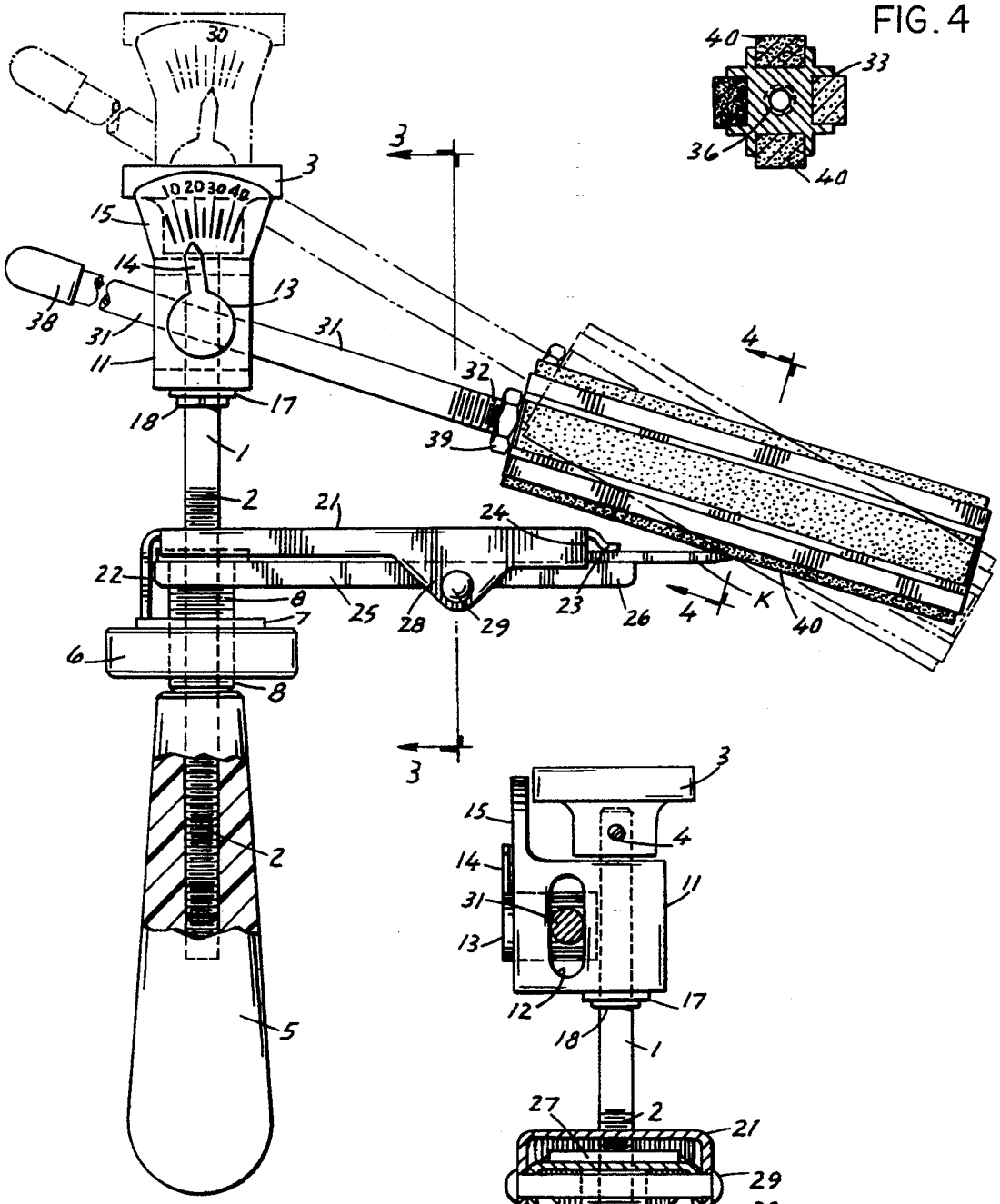
FIG. 4
FIG. 2
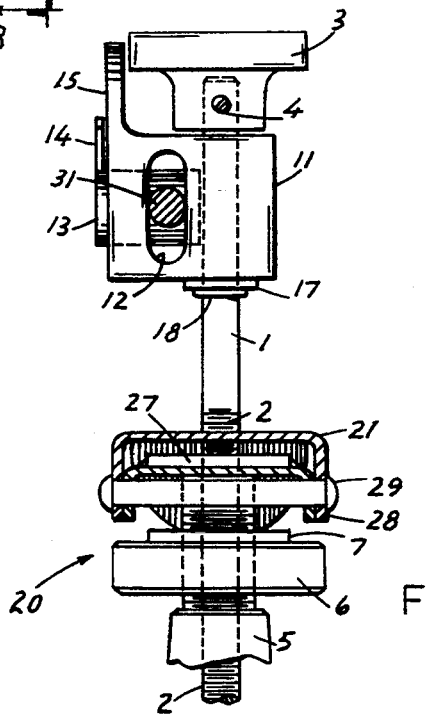
FIG. 3

BLADE SHARPENER

SUMMARY OF THE INVENTION

This invention relates generally to holding devices and to guides. More particularly, this invention relates to an apparatus which is used for sharpening the blades of knives and the like and which is configured with components for releasably holding a blade within a clamping means and for guiding a honing tool or device across the edge of the blade being held.

Blade sharpeners, and particularly knife blade sharpeners, having jaws adapted to grip a knife blade therebetween have long been provided. More recently, such sharpeners have also been provided with guide members adapted to guide a honing tool or device across the edge of the knife blade being sharpened. Such sharpeners have been disclosed, for example, in U.S. Pat. Nos. 4,486,982 to Longbrake and 4,404,873 to Radish.

Sharpeners of this type often include a knife blade clamping portion which holds the knife blade in a generally horizontal plane. A guide member is provided and extends generally perpendicularly relative to the knife blade which has been clamped. The guide member typically contains a series of pre-determined apertures through which one end of a guide rod passes. The guide rod has a honing tool affixed to its other end and is used to guide the honing tool along a certain path of movement relative to the edge of the knife blade which is to be sharpened. The guide member apertures are provided at points which, when the guide rod is passed through the aperture, produce an certain angle relative to the knife blade and the knife blade edge.

One disadvantage with knife sharpeners constructed in accordance with the prior art is that the guide member inaccurately indicates the angle at which the honing tool may be held relative to the knife blade. That is, the guide rod is typically insertable into a finite number, typically 3 or 4, of different positions. Each position purportedly represents an angle at which the honing tool will engage the blade if the guide rod passes through it. The presence of the guide rod within the aperture is, in practice, a relatively loose fit. This looseness also has a tendency, in this inventor's experience, to create "chatter" between the guide rod and the guide member. More importantly, this looseness results in inaccurate angle indications. That is, the guide rod, when inserted into a guide member slot, indicates a finite angle. One should analyze the triangle formed between the honing tool which is in contact with the blade edge to be sharpened, and which establishes the guide rod as the hypotenuse, and the blade thickness which establishes the length of the side adjacent, namely the distance vertically from the blade edge to the bottom of the slot. As the blade thickness changes the length of the side adjacent also changes and subsequently the indicated angle should also change. In the prior art, the angle indication remains the same and presents a false reading. The same problem exists in a plane opposite the hypotenuse. A change from a narrow to a wide blade increases the length of the side opposite the hypotenuse. With the honing tool contacting the blade edge a change in angle should be indicated. The prior art indicates that the sharpening angle remains unchanged.

Another disadvantage with knife sharpeners constructed in accordance with the prior art is that the longitudinal movement of the guide rod, relative to the knife blade, is also limited, but is limited in a different fashion. The apertures of the vertical guide member can constrict the guide rod and actually limit how far along the knife blade the honing tool may pass. In short, the range of movement of the honing tool is limited to the point, in the opinion of this inventor, that efficient usefulness of the sharpener is also limited. Such sharpeners do not allow for easy and complete access to all portions of the knife blade which is to be sharpened without releasing the knife blade, realigning the knife blade within the clamping members and then reclamping the knife blade. Such sharpeners also have a limited mechanical advantage when the knife blade is inserted and clamped between the knife blade jaws. That is, a two screw fastener requires one of the screws to serve as the fulcrum and the other to provide the clamping lever force. It also requires the use of a screwdriver to set the first screw relative to the width of the knife blade.

It is, therefore, a principal object of this invention to provide a new, useful and uncomplicated blade sharpener which has an almost limitless range of movement of the honing tool relative to the blade which is being held and sharpened and which gives the user an accurate indication of what angle the blade is being sharpened to. It is another object of this invention to provide such a sharpener which requires only a minimal number of elements and a minimal number of steps to ready the sharpener for use. It is yet another object of this invention to provide such a sharpener which accomplishes all of this while providing the user with complete access to the blade to be sharpened. It is still another object of this invention to provide a blade clamping means which maximizes mechanical advantage to minimize the user's effort to securely clamp the blade which is to be sharpened.

The present invention has obtained these objects. It provides for a blade sharpener having a blade clamping portion and a honing tool guide extending from the blade clamping portion. The blade clamping portion is vertically moveable relative to the honing tool guide. The honing tool guide is adapted to rotate freely about a support rod by extending through a guide block located along the support rod. The guide block has a honing tool rod which extends through it and which allows the honing tool rod to rotate substantially away from the horizontal to provide almost limitless motion and positioning relative to the blade. The guide block also includes means for precisely setting and measuring the angle at which the blade is sharpened. The clamping portion is provided with clamping elements which maximize mechanical advantage. The foregoing and other features of the sharpener of the present invention will be further apparent from the description which follows.

BRIEF DESCRIPTION OF THE DRAWINGS

FIG. 2 is a left side and partially fragmented elevational view of the sharpener shown in FIG. 1.

FIG. 3 is an enlarged front elevational view along the sectional line 3—3 of the sharpener shown in FIG. 2.

FIG. 4 is a view along the sectional line 4—4 of the honing tool shown in FIG. 2.

DETAILED DESCRIPTION

Figure 1:
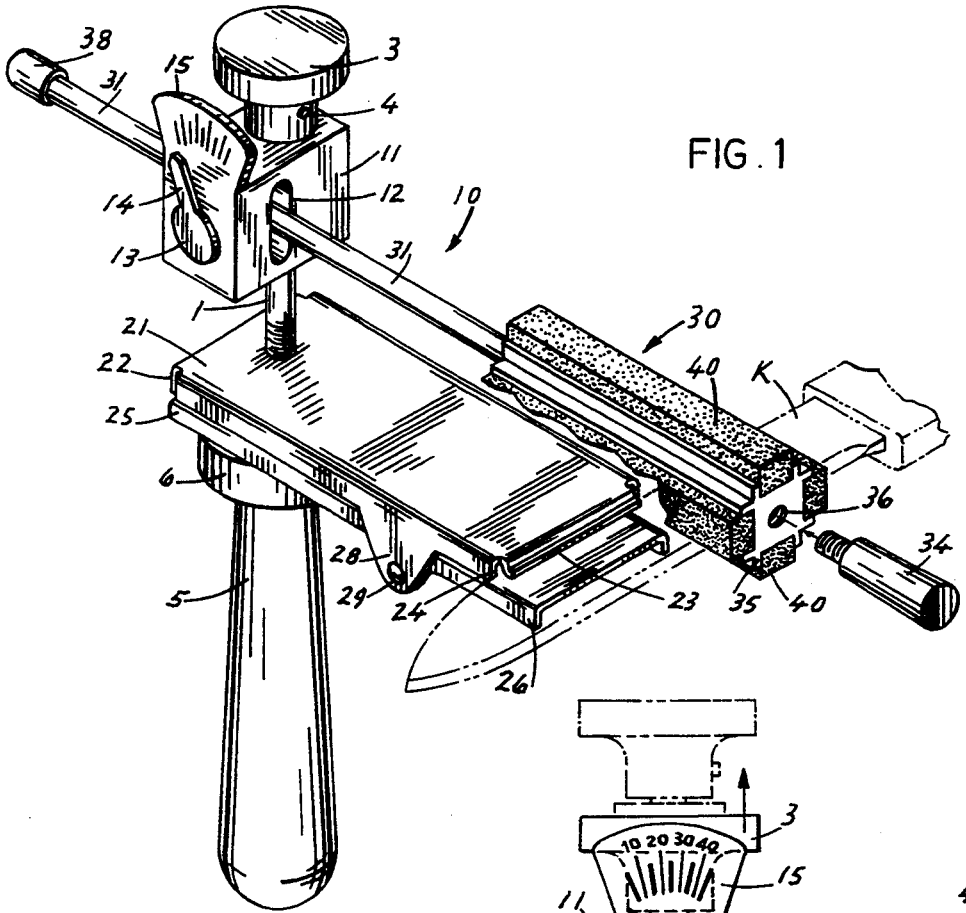
FIG. 1 is a perspective view a blade sharpener constructed according to the present invention.

Referring now to the drawings in detail, FIG. 1 shows a blade sharpener, generally identified 10, constructed in accordance with the present invention. The blade sharpener 10 includes an angle adjustment rod 1 having a lower threaded portion 2. The angle adjustment rod 1 has fixably attached to it at its unthreaded end a knurled knob 2. The knob 3 is unable to rotate about the rod 1 due to a screw 4 which extends through the neck of the knob 3 and into the rod 1. The threaded portion 2 of the angle adjustment rod 1 is functionally adapted to receive a threaded handle 5 which is used to grasp the completely assembled blade sharpener 10.

Figure 5:
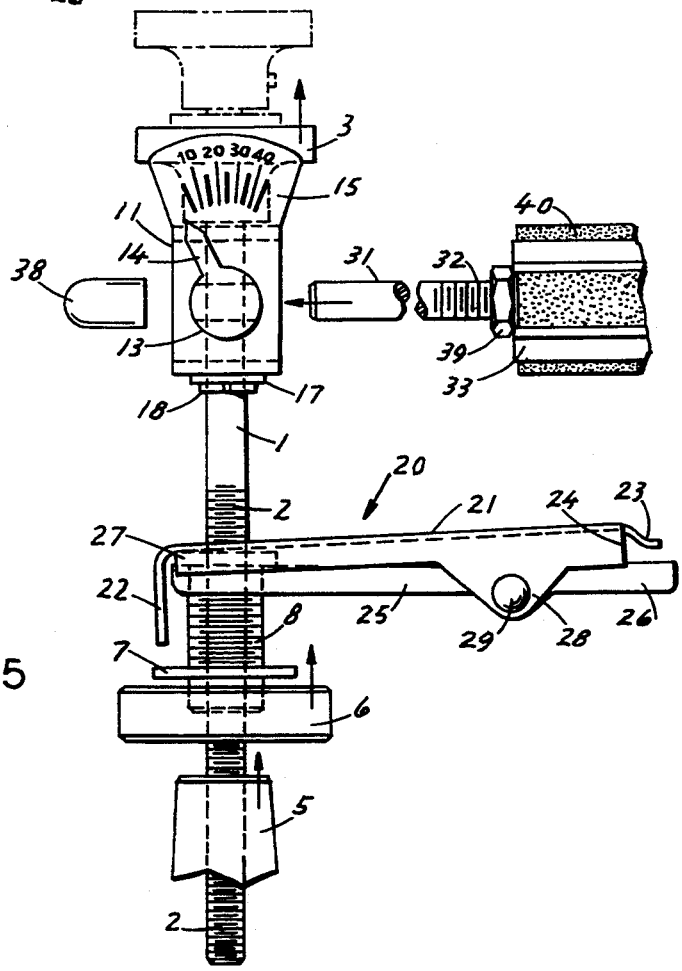
FIG. 5 is a partially exploded and enlarged left side elevational view of the sharpener shown in FIG. 1.

Adjacent the handle 5, and going upwardly along the angle adjustment rod 1, is a knife clamping assembly, generally identified 20. The knife clamping assembly 20 includes a threaded hub 8. The hub 8 is threaded internally and externally. That is, the hub 8 has threads on the inside which functionally compliment the threaded portion 2 of the angle adjustment rod 1. It would also be an acceptable design alternative to eliminate threads from this portion of the angle adjustment rod 1 and to replace the internal threads of the hub 8 with a rubber pressure ring or some other device which would allow incremental movements of the hub 8 along the rod 1 yet keep the hub in fixed longitudinal position when such is desired or required. The hub 8 has threads on the outside which functionally compliment a knurled locking nut 6 and washer 7 situated at its lower end. The upper end of the threaded hub 8 is affixed to one end of a lower clamping plate 25. Above the lower clamping plate 25, but still in relation to the angle adjustment rod 1, is a seat 27 against which may rest a portion of an upper clamping plate 21. See FIG. 5. The lower clamping plate 25 is fastened to the upper clamping plate 21 by virtue of a pin 29 which extends through both plates and, in particular, through a pair of rocker members 28 which extend downwardly from the upper clamping plate 21. The function and positioning significance of the rocker members 28 will become further apparent. The upper clamping plate is also provided with a foot 22, the purpose and function of which will also become apparent further into this description. The upper clamping plate 21 and the lower clamping plate are provided with functionally complimentary clamping portions 23, 26, respectively. The clamping portions 23, 26 are functionally adapted to grasp and to hold a knife blade K therebetween. A heel 24 integral to the upper clamping plate 21 provides a stop and alignment means for the blade to be held. While this detailed description refers to a knife blade K, it is to be understood that virtually any blade or device which utilizes a blade in it and which could be held between the clamping plates 25, 26 could be sharpened by the sharpener of the present invention. This could include scissor blades, lawn mower blades, arrowheads, and the like.

Further upwardly along the angle adjustment rod 1 and situated immediately below the knob 3 is a guide block 11. The guide block 11 has an opening in it, not shown, through which extends the angle adjustment rod 1. This allows the guide block 11 to rotate fully and freely about the angle adjustment rod 1. It is functionally adapted to rotate 360° about the angle adjustment rod 1. The guide block is held in vertical position along the angle adjustment rod 1, just below the knob 3, by virtue of a retaining ring 18. A washer 17 is situated between the guide block 11 and the retaining ring 18. The guide block 11 contains a second opening 12 defined in it. This opening 12 lies to one side of the guide block 11 and has a generally elongated oval shape to it. The guide block 11 has yet another opening, also not shown, which accommodates a hub 13 situated therewithin. The hub 13, in turn, has an opening, also not shown, defined in it. See FIG. 3.

The hub opening lastly described is functionally adapted to receive the honing tool guide rod 31 of the honing tool assembly, generally identified 30. See FIGS. 1 and 5. This configuration is really something that this inventor would call a "universal coupling". That is, the guide block 11, hub 13, angle adjustment rod 1 and honing tool guide rod 31 have typical sleeve bearing fits to afford freedom of movement, but not excessively so. The guide block 11 rotates about the angle adjustment rod 1 in a horizontal plane. The hub 13 rotates within the guide block 11 in a vertical plane. The honing tool guide rod 31 slides axially within the hub 13 and also rotates about its axis within the hub 13.

The honing tool guide rod 31 has affixed to one end a rubber cap 38 and at the other threaded end 32 thereof is a stone holder 33. The stone holder 33 has a plurality of recesses 35 defined within it. Each recess 35 is functionally adapted to receive a honing stone 40 within it. See FIG. 4. At the opposite end of the stone holder 33 is a hole 36 which is threaded and functionally adapted to receive a second threaded handle 34. The stone holder 33 is held in position along the threaded portion 32 of the stone guide rod 31 by virtue of a jam nut 39. See FIG. 5. The universality of movement of the guide block 11, hub 13, angle adjustment rod 1 and honing tool guide rod 31 permits the stone holder 33 and the honing stones 40 situated within it to conform to the general plane of the blade and hone its cutting edge to a preset angle. This achieves a protractor-like function of the device. The contact between the honing stone 40 and the knife blade K as related to the location of the guide block 11 establishes the exact sharpening angle which is read directly from a graduated scale. That is, an arrow 14 located on the hub 13 points to a graduated scale 15 located on the guide block 11. See FIGS. 1, 2 and 5. While this angle can be infinitely varied by rotation of the knob 3 and hub 13, the minimum angle from the horizontal plane is about 10°. The maximum is really unlimited although it is unrealistic to take it out more than 40°.

In application, the user of the blade sharpener 10 assembles the device by inserting the threaded portion 2 of the angle adjustment rod 1 through the upper and lower clamping plates 21, 25 and into the threaded hub 8. The knob 3 is rotated sufficiently to align the guide block 11 in the position generally required by the user. The handle 5 is then threaded onto the threaded portion 2 of the angle adjustment rod 1. The stone guide rod 31 is inserted through the opening 12 of the guide block 11 and through the opening 14 of the hub 13 held within the guide block 11. The knife blade K is inserted between the clamping portions 23, 26 of the upper and lower clamping plates, 21, 25 respectively, with the knife blade facing away from the honing tool assembly 30. The knife blade K is inserted sufficiently that the blade butts up against the heel 24 of the upper clamping plate 21. It is, however, to be understood that if the knife blade K to be sharpened is extremely narrow, it is not necessary for such blade K to butt up against the heel 24. The knurled locking nut 6 is then rotated sufficiently to force the washer 7 into contact with the foot 22 of the upper clamping plate 21. Forcing the foot 22 of the upper clamping plate 21 upwardly results in rotation of the upper clamping plate 21 and the rocker members 28 about the pin 29 thereby forcing the clamping portion 23 of the upper clamping plate 21 into contact with the knife blade K. A substantial mechanical advantage is gained by the device of the present invention. The effort applied to rotate the knurled locking nut results in a multiplication of force of approximately 40 times at the clamping portions 23, 26 of the upper and lower clamping plates 21, 25, respectively. A 20:1 mechanical advantage is derived from the thread between the threaded hub 8 and the knurled locking nut 6. In addition, there is a 2:1 mechanical advantage developed by the ratio of where the force is applied at the foot 22 of the upper clamping plate 21 and its length to the fulcrum, which happens to be at the rocker members 28 and pin 29, and from the fulcrum to the clamping portion 23 of the upper clamping plate 21. In short, a minimum effort, or torque, is required to secure the knife blade K in the clamping portions 23, 26.

The handle 5 is then rotated upwardly to establish contact between it and the threaded hub 8 of the knife clamping assembly. The stone holder 33 is then drawn across the knife blade K to allow sharpening of the knife blade K. The stone holder 33 is rotated to its various sides to obtain different levels of coarseness of the stones 40. If a narrower angle of the knife blade K is desired, the handle 5 is rotated sufficiently to back it away from the knurled locking nut 6 thereby allowing the angle adjustment rod to be rotated by use of the knob 3 to force it further down and through the threaded hub 8. The opposite of this process is used to accomplish a greater angle along the knife blade K.

From the foregoing detailed description of the illustrated embodiment of the invention set forth herein, it will be apparent that there has been provided a new, useful and uncomplicated sharpener which has an almost limitless range of movement of the honing tool relative to the blade which is being held and sharpened, which requires only a minimal number of elements and a minimal number of steps to ready the sharpener for use and which accomplishes all of this while providing the user with complete access to the blade being sharpened.

The principles of this invention having been fully explained in connection with the foregoing, I hereby claim as my invention:

1. A blade sharpener which comprises
a longitudinally extending alignment rod,
a blade clamping means, said blade clamping means being supported by the alignment rod and being moveable along the length of the alignment rod,
means for fixing the position of the blade clamping means at various points along the length of the alignment rod,
a guide rod, said guide rod having a first end and a second end,
means for positioning the first end of the guide rod at a fixed longitudinal position along the alignment rod, and
a blade sharpening member, said blade sharpening member being affixed to the guide rod second end whereby said sharpening member is moveable at various angles along a blade held by said moveable blade clamping means.

2. The blade sharpener of claim 1 wherein said guide rod positioning means comprises a guide rod retaining member rotatably mounted to said alignment rod.

3. The blade sharpener of claim 2 wherein said guide rod retaining member includes means for rotating the guide rod about its axis and for rotating the guide rod to various angles relative to the alignment rod.

4. A blade sharpener which comprises
an alignment rod,
a blade clamping means, said blade clamping means being moveable along the length of the alignment rod,
a guide rod, said guide rod having a first end and a second end,
means for positioning the first end of the guide rod relative to the alignment rod, said guide rod positioning means comprising a guide rod retaining member rotatably mounted to said alignment rod, said guide rod retaining member including means for rotating the guide rod about its axis, for rotating the guide rod to various angles relative to the alignment rod, and for slidably moving the guide rod through said retaining member, and
a blade sharpening member, said blade sharpening member being affixed to the guide rod second end whereby said sharpening member is moveable at various angles along a blade held by said moveable blade clamping means.

5. The blade sharpener of claim 4 wherein said blade clamping means includes a pair of generally coplanar clamping members which are incrementally moveable along the alignment rod away from and/or towards the guide rod retaining member.

6. The blade sharpener of claim 5 wherein the guide rod retaining member includes means for precisely indicating the angle formed between the guide rod and a plane perpendicular to the alignment rod.

7. A blade sharpener which comprises
an alignment rod having an upper portion and a lower portion, said upper rod portion including means for rotating the rod about its axis and said lower rod portion being threaded,
a blade clamping means, said blade clamping means comprising a pair of generally horizontally aligned clamping members extending from a threaded hub which is incrementally moveable along the threaded lower portion of the alignment rod,
a blade sharpening means, said blade sharpening means including a holder for retaining a blade sharpening member therewithin, and
means for guiding said blade sharpening member across a blade retained within said blade clamping members, said guide means comprising a guide rod having a first and a second end, and a guide rod retaining member located at the alignment rod upper portion, said first guide rod end being slidably retained within the guide rod retaining member and said second guide rod end being affixed to the blade sharpening member holder whereby said guide rod is moveable along said blade at variable angles relative to the horizontal.

8. The blade sharpener of claim 7 wherein said guide rod retaining member includes means for rotating the guide rod about its axis and for rotating the guide rod to various angles relative to the alignment rod.

9. The blade sharpener of claim 8 wherein said guide rod retaining member includes means for slidably moving the guide rod through said retaining member.

10. The blade sharpener of claim 9 wherein the guide rod retaining member includes means for precisely indicating the angle formed between the guide rod and a plane perpendicular to the alignment rod.

11. A blade sharpener comprising a blade clamping means, said blade clamping means including a first clamping member having a first surface for engaging one side of a blade and a second clamping member having a surface opposed to said surface of the first clamp member for engaging the other side of the blade, and further including means for moving said first and second clamping members toward one another to releasably clamp a blade therebetween, an alignment rod, said alignment rod extending generally perpendicularly with respect to said blade clamping means and being incrementally moveable with respect to said blade clamping means, a guide rod, said guide rod having a first end and a second end, a guide rod retention member, said guide rod retention member being rotatably mounted to said alignment rod and including means for rotating the guide rod about its axis, for rotating the guide rod to various angles relative to the alignment rod and for slidably moving the first guide rod end through said retention member, and a blade sharpening member, said blade sharpening member being affixed to the guide rod second end whereby said sharpening member is moveable at various angles along a blade held by said blade clamping members.

12. The blade sharpener of claim 11 wherein the guide rod retention member includes means for precisely indicating the angle formed between the guide rod and a plane perpendicular to the alignment rod.

* * * * *